United States Patent [19]

Garcia

[11] Patent Number: 4,587,816

[45] Date of Patent: May 13, 1986

[54] LOCK ASSEMBLY

[76] Inventor: Fidel Garcia, 7770 NW. 22 Ave., Miami, Fla. 33147

[21] Appl. No.: 529,144

[22] Filed: Sep. 2, 1983

[51] Int. Cl.[4] ..... E05B 63/00

[52] U.S. Cl. ..... 70/417; 70/379 R; 70/381; 70/448; 70/452; 292/337

[58] Field of Search ..... 70/DIG. 60, 416, 417, 70/379-381, 379 R, 379 A, 452, 447-450; 292/337, 346

[56] References Cited

U.S. PATENT DOCUMENTS

| | | | |
|---|---|---|---|
| 200,156 | 2/1878 | Towne et al. | 70/417 |
| 631,431 | 8/1899 | Phelps | 70/452 |
| 1,549,603 | 8/1925 | Murmann | 70/380 |
| 1,675,594 | 7/1928 | Bouchery | 70/417 |
| 3,699,788 | 10/1972 | Gerlach et al. | 70/417 X |
| 4,073,172 | 2/1978 | Schlage | 70/417 |
| 4,422,314 | 12/1983 | Cooper | 78/417 X |

FOREIGN PATENT DOCUMENTS

| | | | |
|---|---|---|---|
| 1553324 | 12/1970 | Fed. Rep. of Germany | 70/452 |
| 184094 | 12/1955 | Netherlands | 70/452 |
| 72136 | 12/1928 | Sweden | 70/379 R |

*Primary Examiner*—Robert L. Wolfe
*Assistant Examiner*—Lloyd A. Gall
*Attorney, Agent, or Firm*—John Cyril Malloy

[57] ABSTRACT

A lock assembly of the type mounted on a door or like closure structure and including two lock cylinders each at least partially encased and surrounded by a casing structure each of which has reinforcing means formed thereon so as to prevent collapse or destruction of said casing structure upon receiving an extreme force such as a blow with a hammer or the like. An activating structure is interconnected between a bolt element and each of the lock cylinders such that rotation of either lock cylinder, as by a key, causes at least partial rotation of the activating structure and linear movement of the bolt element into either an extended or retracted position.

6 Claims, 13 Drawing Figures

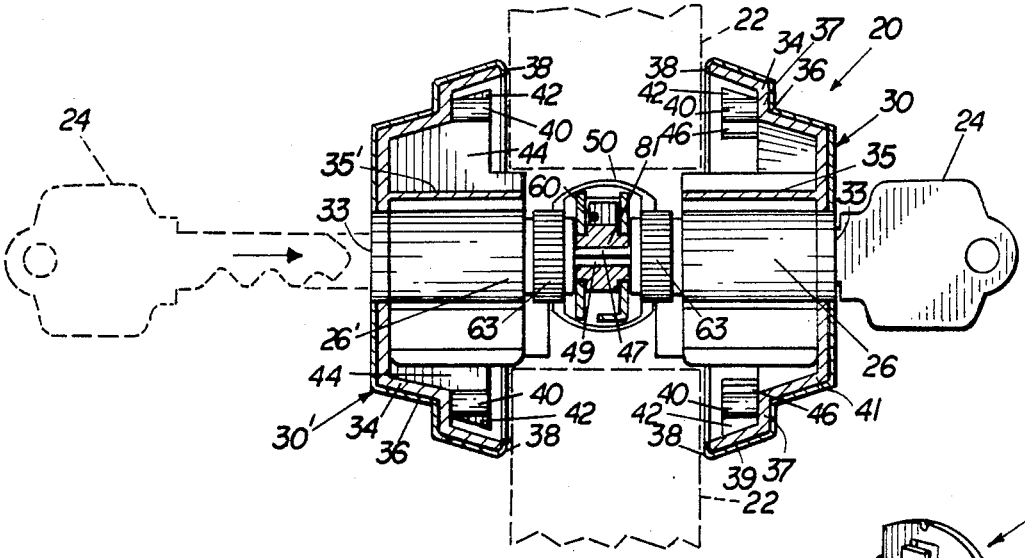
FIG. 4
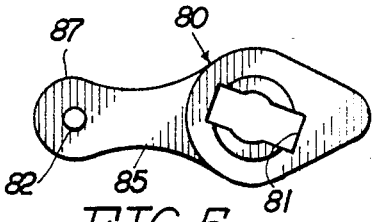
FIG. 5
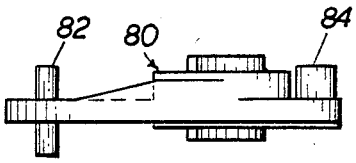
FIG. 6
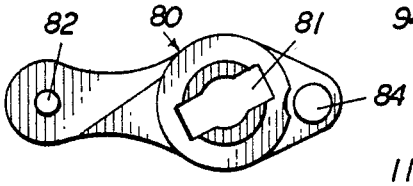
FIG. 7
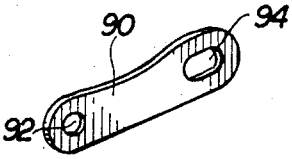
FIG. 8
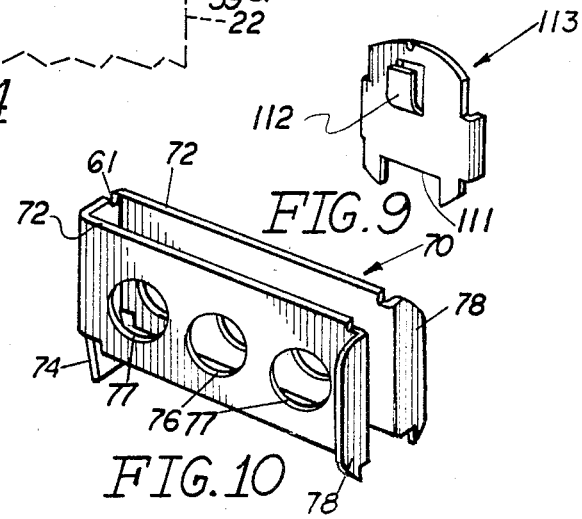
FIG. 9
FIG. 10
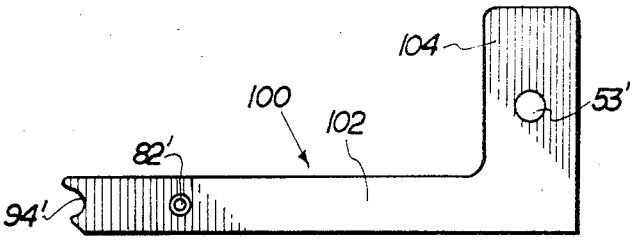
FIG. 11
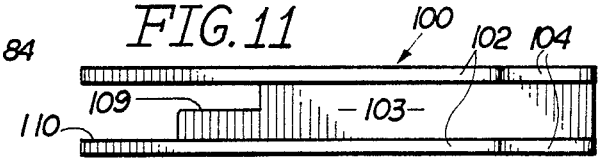
FIG. 12
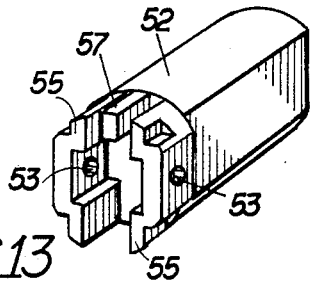
FIG13

LOCK ASSEMBLY

BACKGROUND OF THE INVENTION

1. Field of the Invention

The present invention is directed towards a lock assembly comprising a casing means disposed in surrounding and protective relation to each of two lock cylinders. Reinforcing means is integrally formed on the casing and specifically structured and disposed to prevent destruction or collapse of the casing and resulting damage of the lock cylinders and entire lock assembly upon the casing means being subjected to extreme force such as by a hammer or the like.

2. Description of the Prior Art

Both single cylinder and double cylinder dead bolt lock mechanisms have of course been well known in the prior art for many years. Single cylinder dead bolt lock mechanisms which include a thumb turn knob at the side opposite to the cylinder lock are also well known and commercially popular. Conventionally, locks of this type include the extending and retracting of the latch bolt by use of either the lock cylinder or the thumb turn knob. Disadvantages of this type of structure includes the ability to quickly open the lock from the inside merely by operating the thumb turn knob thereby allowing for easy escape. However, double cylinder dead bolt lock structures while overcoming the above type of problem are more expensive.

There is accordingly a demand for a dead bolt type lock mechanism which may be installed on doors or like closure structures and operated by a key from either side of the closure. Prior dead bolt locks are characterized by rim cylinders with exposed or weakly shielded attaching screws. The use of such attaching screws significantly reduces the security of the lock. Also, the rim cylinders employed in prior dead bolt locks also have the deficiency of employing lazy cam tail pieces which are unique to their respective locks and which are often flimsy in their construction.

In order to overcome the above noted problem in the prior art lock mechanisms, efforts should be directed to the provision of reinforcing structure incorporated in the casing means or surrounding casing structures disposed in substantially protecting relation to separate lock cylinders of a double cylinder dead bolt lock structure.

SUMMARY OF THE INVENTION

The present invention is directed towards a double cylinder dead bolt lock mechanism of the type designed to be mounted on a closure structure such as a door or the like and further, wherein the lock cylinders are specifically designed to be key operated.

More specifically, the lock assembly of the present invention comprises a first and a second lock cylinder disposed in spaced apart relation to one another and disposed on substantially opposite sides of the closure or door structure on which the assembly is mounted. A casing means is provided in substantially protecting relation to the lock cylinder. The casing means includes two casing structures having a closed exposed face centered about the key aperture provided for entrance of the key into the cylinder. The opposite or open face of each cylinder structure is mounted flush to the corresponding surface of the closure or door on which the assembly is secured. Each of the casing structures is disposed in substantially surrounding, protecting relation to one of the lock cylinders and has a peripheral wall spaced apart from the respective lock cylinder and positioned in substantially encasing or enclosing relation thereto.

A cylinder cover or sleeve is integrally formed on each of the casing structures and disposed in substantially concentric relation about the separate lock cylinders so as to form a sleeve-like configuration on the interior of each of the casing structures for surrounding relation to the respective lock cylinders.

An important feature of the present invention is the provision of reinforcing means integrally formed on the casing means. More specifically, the reinforcing means of the present invention includes, in one embodiment, a plurality of spaced apart ribs integrally formed on the interior of at least one casing structure and extending radially outward from the sleeve of the cylinder cover to the outer peripheral wall of the casing structure. A plurality of these rib elements are disposed in substantially equally spaced apart relation to one another. Such ribs are made from a high strength metal and the provision and structure of such reinforcing ribs makes it extremely difficult to cause a collapse or destruction of the casing structure when they are subjected to extreme force such as from blows by a hammer. Accordingly, the reinforcing means further serves to protect the lock cylinder and prevent destruction of the entire lock assembly.

Each of the lock cylinders has an outwardly protruding tongue. Each tongue from each of the lock cylinders is disposed in overlapping relation to one another and collectively disposed in a central aperture of a throw link. The throw link is one component of the activating means which is structured and disposed in interconnecting relation between the lock cylinders and the bolt element. Accordingly, rotation of either of the lock cylinders by an inserted key causes a rotation of the throw link and consequential linear movement of the bolt element into and out of an extended position. One end of the throw link is pivotally connected to a positioning arm at one end thereof. The positioning arm is disposed at its opposite end to the interiorly positioned end of the dead bolt. Accordingly, rotation of the throw link causes linear movement of the positioning arm and resulting linear movement of the bolt element either into or out of the bolt housing.

BRIEF DESCRIPTION OF THE DRAWINGS

For a fuller understanding of the nature of the present invention, reference is made to the following detailed drawing, in which:

FIG. 4 is a sectional view along line 4—4 of FIGS. 1 and 2 wherein the operating key and closure or door portion is represented in broken lines.

FIG. 5 is a front plan view of a throw link which is a component of the activation means of the present invention.

FIG. 6 is a top plan view of the structure of FIG. 5.

FIG. 7 is a rear view of the structures of FIGS. 5 and 6.

FIG. 8 is an isometric view of a connecting link which is a component of the activation means of the present invention.

FIG. 9 is an isometric view of a retaining cap disposed to interconnect portions of the activating means to the bolt housing.

FIG. 10 is an isometric view of the housing structure for the activating means of the present invention.

FIG. 11 is a front plan view of the positioning arm of the present invention.

FIG. 12 is a top plan view of the structure of FIG. 11.

FIG. 13 is an isometric view of the bolt element of the present invention.

Similar reference characters refer to similar parts throughout the several views of the drawings.

DETAILED DESCRIPTION OF THE PREFERRED EMBODIMENT

Figure 1:
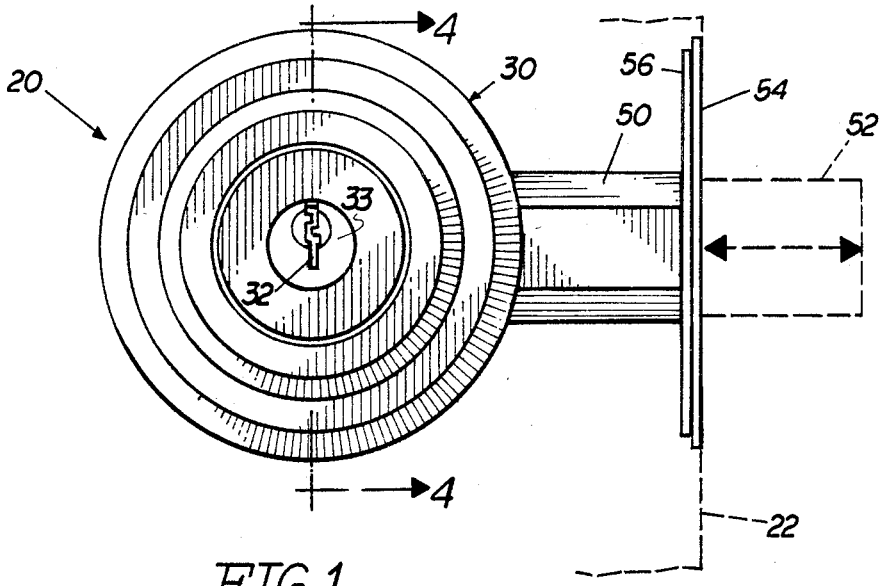
FIG. 1 is a front plan view of the lock assembly of the present invention with the bolt element shown in its outwardly extended position in broken lines.

As shown in FIGS. 1 through 4, the lock assembly of the present invention is generally indicated as 20 and includes a double cylinder construction including a first cylinder 26 and a second cylinder 26'. The lock assembly is mounted on a closure such as a door or like structure indicated in broken lines as 22 wherein the first and second cylinders are mounted on opposite sides of the door or closure 22 in the conventional fashion for double cylinder lock assemblies. A key 24 is configured to enter key aperture 32 in the exposed end 33 of each cylinder 26 and 26'. In the conventional fashion, the key is inserted into the interior of the cylinder to engage the workings therein. Rotation of the key 24 once positioned within either of the cylinders 26 or 26' causes rotation of the respective cylinder and operation of the activting means as will be explained in greater detail hereinafter. The present invention further comprises a casing means including two casing structures 30 and 30' disposed and structured for surrounding, protecting relation with each of the respective cylinders 26 and 26'. The exterior of each of the casing structures 30 and 30' includes a decorative facing 36 which may be of finished metal or like material. The interior structural wall 34 is in cap-like form including an annular skirt disposed in spaced apart but surrounding relation to each of the respective cylinders. Each of the cylinder structures also includes a cylinder cover 35 and 35' which is configured in a substantially sleeve-like configuration and disposed in surrounding substantially concentric relation about the exterior of each of the cylinders 26 and 26' respectively.

Figure 3:
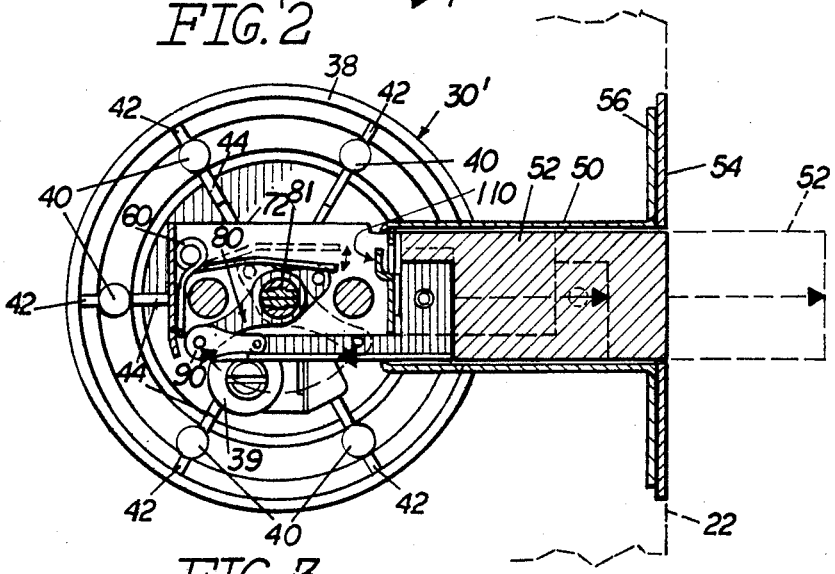
FIG. 3 is a sectional view along line 3—3 of FIG. 2.

With reference to FIGS. 3 and 4, an important feature of the present invention comprises the provision of reinforcing means integrally attached to the casing means so as to prevent its destruction when subjected to extreme force such as by blows of a hammer. This reinforcing means therefore prevents additional damage to the individual cylinders and would further prevent inoperability of the lock assembly which would enable unauthorized entry as during a burglary or the like.

The reinforcing means comprises a plurality of ribs integrally formed on the interior of the casing structures and fixedly disposed between the cover and the inner surface of the surrounding wall 34 of the casing structure.

With specific reference to FIG. 3, a preferred embodiment of the present invention is the provision of at least one of the casing structures 30' including a reinforcing means comprising a first plurality of ribs disposed in spaced apart relation to one another and extending radially outward from and along the entire length of the exterior of the cylinder cover 35' to the interior surface of the surrounding peripheral wall 34 of the casing structure 30'. Each of the ribs comprises a main rib portion 44 integrally formed to extend at a peripheral edge from the exterior of the cylinder cover 35' to a reinforcing finger 40. A secondary rib portion 42 extends from the reinforcing finger 40 outwardly to integrally engage at a peripheral edge the interior surface of the peripheral wall 34. In the embodiment shown in FIG. 3, each of the ribs are disposed in equally spaced apart relation to one another and extend radially outwardly a substantially equal distance from the centrally located cylinder cover 35'.

With reference to FIG. 4, the casing structure 30' which is heavily reinforced as disclosed in FIG. 3 is best placed on the exterior of the door or closure 22 where the chances are more likely that it will be subjected to tampering, and abusive treatment. The casing structure 30 includes a plurality of ribs equally spaced about substantially the outer periphery of the casing structure wherein each of the ribs includes an extended rib portion 46, a reinforcing finger 40 and a secondary rib portion 42. More specifically, each of these ribs are disposed in a substantially circular array and are positioned on the interior surface of transition rim portion 37 integrally located between peripheral rim 39 and the annular body portion 41. Note that each of the structural components 37, 39 and 41 are an integral part of the surrounding peripheral wall 34 of the casing structure 30.

Figure 2:
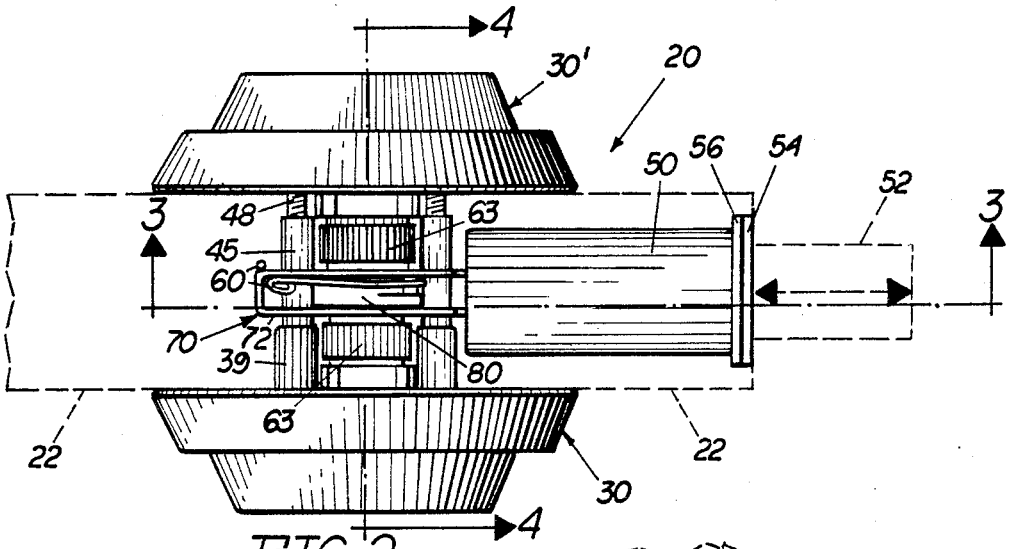
FIG. 2 is a top plan view of the lock assembly of the present invention with the door or closure on which it is mounted and the extended position of the bolt represented in broken lines.

As shown in FIG. 2, the casing structures 30 and 30' are interconnected to one another by means of threaded type connectors 48 attached to casing structure 30' being extended and connected to internally threaded socket portions 45 having a socket base 39 being attached or mounted on casing structure 30.

Further structural features of the cylinder locks include knurled rings 63 provided for the connection and disconnection of the cylinders themselves from the lock assembly. Turning to FIGS. 3 and 4, each of the cylinders 26 and 26' includes an outwardly projecting tongue 47 and 49 respectively which are disposed in overlapping relationship to one another and extend through a central aperture 81 in the throw link 80. Accordingly, when one of the cylinders 26 or 26' is rotated by activation of key elements 24, the respective projecting tongues 47 and 49 also rotate which in turn causes a rotation of the throw link 80. Throw link 80 comprises one of the components in the activating means wherein the activating means is structured and disposed to convert the rotational motion of each of the cylinders 26 and 26' to the linear motion of the bolt element as it is positioned into and out of its extended position as shown in broken lines in FIGS. 1, 2 and 3.

More specifically, the activating means is mounted within a housing bracket 70 (FIG. 10). This bracket has two parallel leg elements 72 disposed in spaced apart relation to one another and each leg has a plurality of three apertures including end apertures 77 and a central aperture 76. With reference to FIG. 2, each of the connecting socket portions 45 pass through the end apertures 77 for interconnection with the screw threaded fasteners 48. However, the tongue elements 47 and 49 extending outwardly from the interior end of each of the cylinders 26 and 26' pass into the central aperture 81 of the throw link 80 through the central aperture 76 in the housing bracket 70. Accordingly, rotation of the cylinders causes a reciprocal movement or rotation of the throw link 80 to its forward and rear position as will be explained in greater detail with reference to FIG. 3.

As shown the throw link 80 is positioned in its rear orientation such that leg portion 85 is directed away from the bolt element 52. As its distal end 87 (see FIG. 5) a pivot pin 82 is mounted thereon and pivotally engages the correspondingly positioned end of the connecting link 90. More specifically, elongated aperture 94 fits about the pivot pin 82 on the throw link 80. The front or foremost end is connected by a connector pin which extends through connecting aperture 82' in the positioning arm (see FIG. 11). Accordingly, movement or pivotal rotation of the throw link in the position, represented in solid lines in FIG. 3, causes linear movement of the positioning arm 100 into its retracted position. This in turn causes the retracted position and linear movement of the bolt element 52.

As best shown in FIGS. 11 and 12 positioning arm 100 includes an elongated configuration having two upstanding spaced apart and substantially parallel legs 102 interconnected along their bottom edge by an integrally formed connecting base 103. Further, the positioning arm 100 includes an upstanding portion defined by two spaced apart flanges 104. A connecting aperture 53' is located through both of the flanges 104. With reference to FIG. 13, the bolt element 52 includes connecting portions 55 spaced apart such that upstanding flanges 104 of the positioning arm 100 can fit therebetween and straddle either side of the projecting finger 57. A connecting pin passes through apertures 53 in each of the flanges 55 and also through the apertures 53' in the flanges 104. This provides a firm connection such that linear movement of the positioning arm 100 due to its connection to the throw link 80 causes linear movement of the bolt element 52 into and out of its extended position.

With reference to FIG. 12, the cutout portions 109 and 110 are integrally provided in the base 103 so as to provide clearance for throw link 80 and connecting link 90 when they are reciprocally rotated.

Again with reference to FIG. 3, and as represented in broken lines, the throw link 80 has its leg portion 85 thrown forward such that the end 87 connected to connecting link 90 forces the positioning arm in its outward extended position which in turn forces the extension of the bolt element 52 out of its casing. Other structural features as represented in FIGS. 2 and 3 include a bolt housing 50 having an elongated hollow configuration for passage and maintenance of the bolt element 52 therein.

Other structural features include the provision of a retaining spring 60 having its uppermost portion (FIG. 3) engaging projecting finger 84 (see FIG. 6) so as to maintain the throw link 80 in either its forward or rearward position. Referring to FIGS. 3 and 10, the notch 61 is provided for passage of the spring element therethrough and maintenance of the spring element 60 in its intended position. Further structural features include the depending tongue 74 positioned in in-line relation with the connecting link 90 so as to prevent fouling of any portion of the actuating means with other interior components within the lock assembly.

Again with reference to FIGS. 9 and 10 the housing bracket 70 is maintained in place about the throw link 80 and connecting link 90 by virtue of outwardly extending flanges 78 integrally formed on the free end of each of the legs 72 of the bracket 70. These flanges 78 fit on the interior of the bolt housing 50 and are maintained in place by a retaining cap 113 when the flanges 78 are positioned on the interior of the housing 50 on opposite sides of the outwardly projecting tongue 112. Further, the tongue 112 fits between the leg 72 and allows passage of the extending legs 102 of the positioning arm 100 effectively beneath the retaining cap 113 and through formed passageway 111.

What is claimed is:

1. A lock assembly of the type including a double cylinder construction mounted on a closure such as a door, said lock assembly comprising:

(a) a first and a second lock cylinder constructed to rotate and be key operated, (b) casing means including two casing structures each including a continuous cylindrical configuration disposed in surrounding, substantially covering and protecting relation to separate ones of said lock cylinders, (c) a cylinder cover formed on an interior of each of said two casing structures and each comprising an elongated, open-ended sleeve disposed in surrounding and at least partially covering relation to respective ones of said lock cylinders, (d) reinforcing means integrally formed on each of said two casing structures for protection of said lock cylinders and comprising a first plurality of ribs formed on the interior of one of said casing structures in a substantially circular array and collectively surrounding a respective one of said cylinder covers, (e) each of said first plurality of ribs having an elongated substantially planar configuration with one peripheral edge thereof secured to and extending along the entire length of said respective cylinder cover and an opposite peripheral edge secured to and extending along the length of an interior surface of said respective casing structure, (f) said first plurality of ribs collectively disposed to extend radially outward from said respective cylinder cover to an inner periphery of said casing structure, whereby said reinforcing means is disposed in protecting and substantially surrounding relation to said respective cylinder cover, (g) each of said plurality of ribs having a finger portion integrally formed therein along its length and intermediate the ends thereof, each of said finger portions including a solid, one piece construction having a transverse dimension greater than the transverse dimension of said respective rib, (h) a bolt element interconnected to said lock cylinder and movable between a retracted and extended position upon rotation of at least one of said lock cylinders, (i) activating means interconnected between said first and said second lock cylinders and said bolt element and including a throw link connected to rotate with each of said lock cylinders, and (j) said throw link being interconnected to said bolt element and said activating means further structured to translate rotational movement of said lock cylinders and said throw link into linear movement of said bolt element.

2. A lock assembly as in claim 1 wherein a second one of said casing structures includes a second plurality of rib elements each integrally formed on the interior surface of said second casing structure in spaced apart relation from said respective cylinder cover and disposed in fixed secured engagement with an inner peripheral surface of said casing structure, each of said rib elements of said second plurality of ribs including a finger portion disposed substantially intermediate the ends of said rib element and including a solid construction and having a transverse dimension greater than the transverse dimension of said respective rib elements of said second plurality of rib elements.

3. A lock assembly as in claim 1 wherein said activating means comprises a connecting link movably attached to both said throw link and a positioning arm, said connecting link disposed and structured to linearly displace said positioning arm upon rotation of said throw link.

4. A lock assembly as in claim 3 wherein said positioning arm is disposed in interconnecting relation between said throw link and said bolt element, said positioning arm movably attached at one end to said connecting link and at the other end to said bolt element, said bolt element forced into a retracted and extended portion upon rotation of said throw link in opposite directions.

5. A lock assembly as in claim 4 wherein said activating means further includes a housing bracket disposed and structured for surrounding relation to at least a portion of said activating means including said throw link and said connecting link.

6. A lock assembly as in claim 5 wherein said housing bracket comprises two spaced apart legs disposed in substantially parallel relation to one another and on opposite sides of said throw link, both of said legs including a plurality of apertures formed therein, said lock cylinders connected to said throw link through two substantially aligned apertures formed on separate legs, and said casing structures attached together by connectors extending through other aperture pairs formed in said legs.

* * * * *